US010472822B1

(12) United States Patent
Castro

(10) Patent No.: US 10,472,822 B1
(45) Date of Patent: Nov. 12, 2019

(54) INSULATED INTERLOCKING SUPERBLOCKS FOR CONSTRUCTING AND SUPPORTING STRUCTURAL ELEMENTS OF A BUILDING

(71) Applicant: Juan Diego Castro, Tucson, AZ (US)

(72) Inventor: Juan Diego Castro, Tucson, AZ (US)

( * ) Notice: Subject to any disclaimer, the term of this patent is extended or adjusted under 35 U.S.C. 154(b) by 0 days.

(21) Appl. No.: 16/436,517

(22) Filed: Jun. 10, 2019

Related U.S. Application Data

(60) Provisional application No. 62/740,716, filed on Oct. 3, 2018.

(51) Int. Cl.
*E04B 2/32* (2006.01)
*E04C 1/40* (2006.01)
*E04B 2/02* (2006.01)

(52) U.S. Cl.
CPC ..... *E04B 2/32* (2013.01); *E04C 1/40* (2013.01); *E04B 2002/0228* (2013.01)

(58) Field of Classification Search
CPC ..... E04B 2/32; E04B 2002/0228; E04C 1/40
USPC ..... 52/272
See application file for complete search history.

(56) References Cited

U.S. PATENT DOCUMENTS 2,684,589 A 7/1954 Perreton
3,204,381 A * 9/1965 Perreton ..... E04B 2/46 52/309.12
3,618,279 A * 11/1971 Sease ..... E04B 2/46 52/223.7
4,075,808 A * 2/1978 Pearlman ..... E04B 2/54 52/439
4,498,266 A * 2/1985 Perreton ..... E04C 1/41 52/405.4
4,614,071 A * 9/1986 Sams ..... E04C 1/41 52/309.12
4,856,249 A * 8/1989 Nickerson ..... E04C 1/41 52/405.4
5,802,797 A * 9/1998 Storer-Folt ..... E04B 2/44 52/592.5
6,722,094 B1 * 4/2004 Judd ..... E04C 1/41 52/404.1

(Continued)

FOREIGN PATENT DOCUMENTS

WO WO1993015286 A1 8/1993

OTHER PUBLICATIONS

"Dry-Stacked Interlocking Masonry System (Motarless)", https://theconstructor.org/building/dry-stacked-interlocking-masonry-system-mortarless/9029/.

*Primary Examiner* — Jeanette E Chapman

(57) ABSTRACT

An insulated interlocking superblock assembly enables the quick and convenient construction and support of structural elements of a building. At least one all-structure is utilized to construct a wall for the building. The wall-structure includes a planar base body, a first lining, a second lining, and a plurality of interlocking features. The planar base body is constructed out of a plurality of blocks. Further, the plurality of blocks is arranged into a grid pattern to form a continuous planar structure. A corresponding feature from the plurality of features engages an arbitrary block to an adjacent block, thereby allowing the planar base body to be rapidly erected. The first lining is attached along a first lengthwise edge of the planar base body. Similarly, the second lining is attached along a second lengthwise edge of the planar base body, thereby allowing the attachment of the ceiling and the floor.

14 Claims, 17 Drawing Sheets

(56) References Cited

U.S. PATENT DOCUMENTS

| | | | | |
|---|---|---|---|---|
| 6,735,913 | B2 | 5/2004 | Sanders et al. | |
| 6,962,028 | B2 * | 11/2005 | Banova | E04B 2/44 52/379 |
| 8,549,811 | B2 | 10/2013 | Dyson | |
| 2008/0236081 | A1 * | 10/2008 | Kennedy | E04C 1/41 52/405.1 |
| 2013/0263544 | A1 * | 10/2013 | Pfeiffer | E04B 2/8617 52/407.1 |
| 2014/0333313 | A1 * | 11/2014 | Surampudi | H01M 10/48 324/426 |

* cited by examiner

INSULATED INTERLOCKING SUPERBLOCKS FOR CONSTRUCTING AND SUPPORTING STRUCTURAL ELEMENTS OF A BUILDING

The current application claims a priority to the U.S. Provisional Patent application Ser. No. 62/740,716 filed on Oct. 3, 2018.

FIELD OF THE INVENTION

The present invention generally relates to interlocking, insulated, construction blocks. More specifically, a plurality of interlocking, insulated blocks is configured to support the walls, the ceiling, and the floors of a building.

BACKGROUND OF THE INVENTION

Construction of buildings and homes are an integral facet of present society. For most construction needs, a construction block, or a superblock, is a common building or construction material. Superblocks come in a variety of shapes and sizes, depending on the structural or insulating needs of the construction project. To make the construction process more efficient and streamlined, users might often utilize interlocking superblocks because these devices often provide channels to allow for the pouring of concrete. However, most of these devices do not also provide means of insulation, while still allowing for a channel for the pouring of concrete.

The objective of the present invention is to provide users with a competitive, environmentally-friendly building system utilizing a series of staggered, insulated, interlocking, vertical and horizontal superblocks. Superblocks are made with recycled polystyrene and cement and allow for the means of insulating while also allowing self-aligned assembly and easy installation for reduced number of steel rebars and small amounts of concrete. Conventional block systems and ICF blocks in today's market use large amounts of steel rebars and concrete delivering 4 to 7 times the strength of regular forms of construction but at higher costs.

The present invention provides a competitive, economical system while still delivering a long-lasting product, that is still structurally stronger in many ways than any wood or metal stud frame system. Integrating the vertical reinforced wall columns, with horizontally reinforced concrete beams and thin concrete floors (or roofs) creates a complete structural envelope multiplying their structural value. Preferably, standard superblocks measure 40" in length, 20" in height, and 8", 10", or 12" in width.

DETAILED DESCRIPTION OF THE INVENTION

All illustrations of the drawings are for the purpose of describing selected versions of the present invention and are not intended to limit the scope of the present invention.

Figure 1:
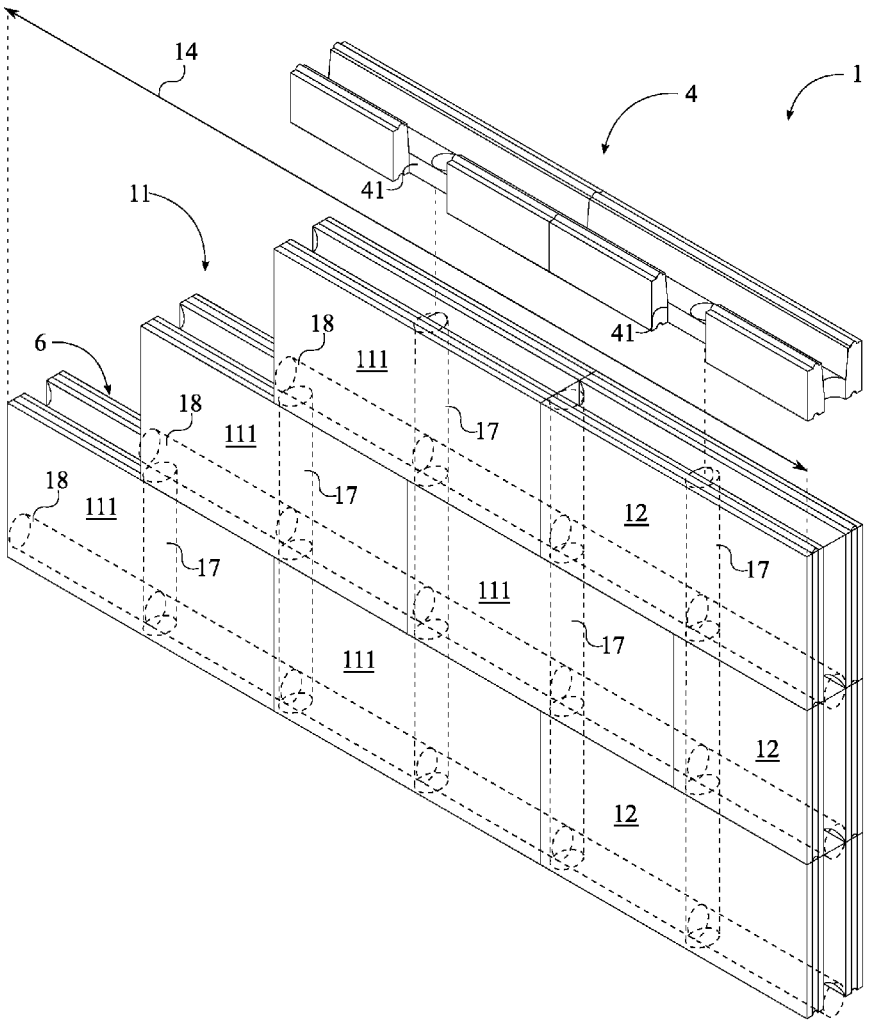
FIG. 1 is an exploded top perspective view of the at least one wall-structure illustrating the connections between the first lining and the planar base body.

The present invention is an insulated interlocking superblock. More specifically, as can be seen in FIG. 1, the present invention comprises a plurality of blocks 111 that are simply stacked without the use of grout or glue. The plurality of blocks 111 are used to quickly and conveniently construct at least one wall-structure 1 that is used as part of a building. Preferably, the wall-structure comprises a planar base body 11, a first lining 4, and a plurality of interlocking features 6. Preferably, the planar base body 11 supports the weight of the ceiling and the additional floors of the building. The preferred embodiment of the plurality of blocks 111 is an insulating block with the plurality of interlocking features 6 allowing steel rebars to inserted between the plurality of blocks 111. The plurality of blocks 111 is arranged into a grid pattern. More specifically, the plurality of blocks 111 is stacked on top of each other in a staggered formation.

Figure 2:
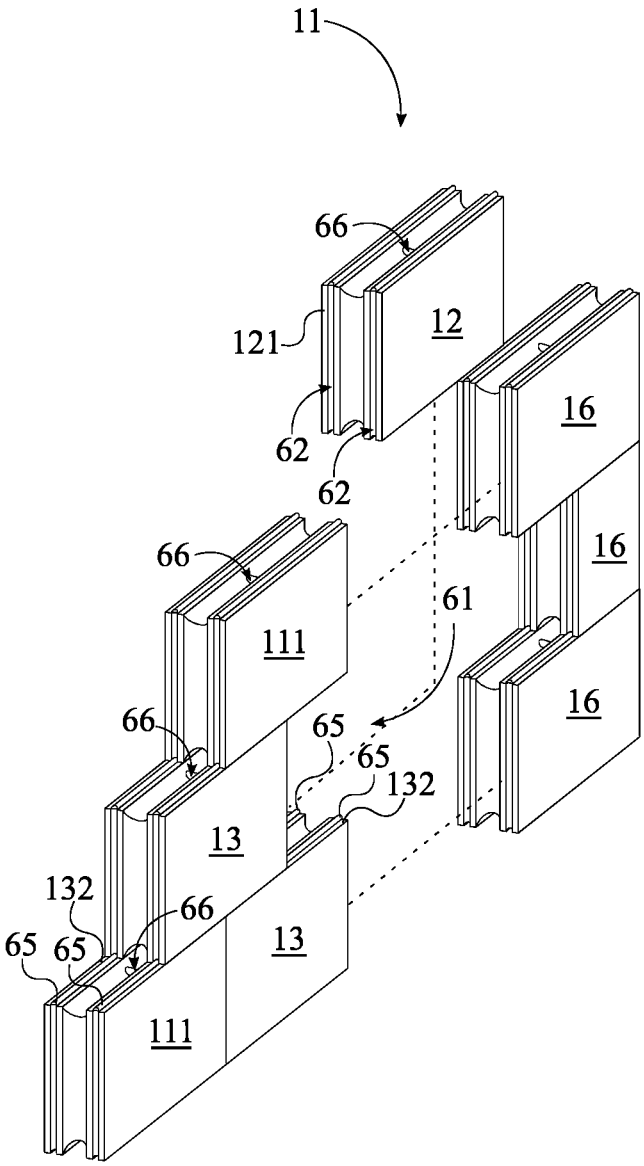
FIG. 2 is a top-left exploded view of the planar base body illustrating the connection between the arbitrary block and the adjacent block.

Referring to FIG. 1 and FIG. 2, in the preferred embodiment, the plurality of interlocking features 6 may be vertical and horizontal tracks and ridges fashioned into the vertical and horizontal side of the block. Accordingly, an arbitrary block 12 from the plurality of blocks 111 is engaged to an adjacent block 13 from the plurality of blocks 111 by a corresponding feature 61 from the plurality of interlocking features 6, wherein the arbitrary block 12 is any block from the plurality of blocks 111. The corresponding feature 61 temporarily holds the arbitrary block 12 and the adjacent block 13 together before concrete and rebar is added for a more permanent connection. In the preferred embodiment, during the assembly of the planar base body 11, small amounts of polyurethane dots between the plurality of blocks 111 are used to temporarily hold the plurality of blocks 111 together until the horizontal recesses are filled with structural concrete. The polyurethane dots provide temporary support until the concrete cures and secures the rebar. The cured concrete provides the structural support for the planar base body 11 together once assembled.

The first lining 4 creates a recess on top of the planar base body 11 for the insertion of the ceiling. As such, the first lining 4 is attached along a first lengthwise edge 14 of the planar base body 11. This allows the ceiling to be mounted on top of the planar base body 11.

Figure 3:
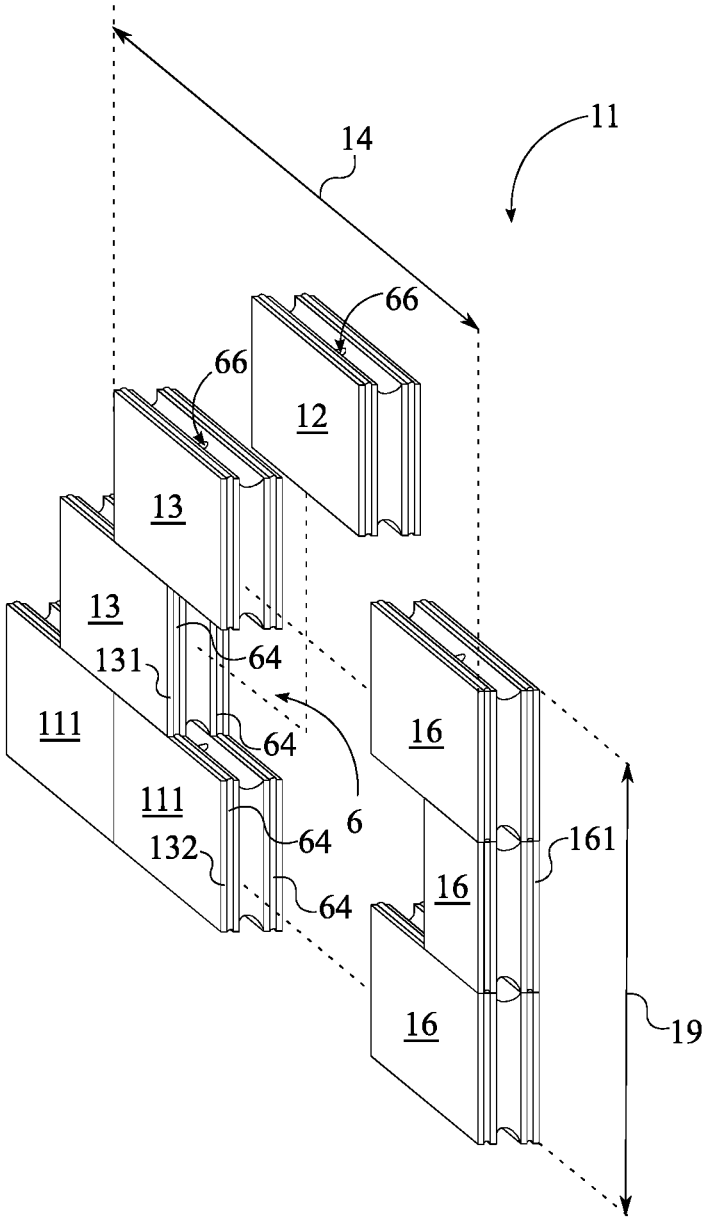
FIG. 3 is a top-right exploded view of the planar base body illustrating the connection between the second lateral side of the adjacent block and the first lateral side of the arbitrary block.

Referring to FIG. 2 and FIG. 3, in the preferred embodiment, the corresponding features 61 comprises a first plurality of tracks 62, and a first plurality of ridges 64. Each of the first plurality of tracks 62 forms an interlocking connection with a corresponding ridge from the first plurality of ridges 64. Preferably, the first plurality of ridges 64 and the first plurality of tracks 62 are vertically oriented to the planar base body 11. As such, first plurality of tracks 62 traverse into a first vertical side 121 of the arbitrary block 12. Further, the first plurality of ridges 64 is integrated into a second vertical side 131 of the adjacent block 13. This enables the arbitrary block 12 to attach to the side of the adjacent block 13. As such, the first vertical side 121 of the arbitrary block 12 and the second vertical side 131 of the adjacent block 13 are positioned adjacent to each other. This enables the first plurality of ridges 64 to engage the first plurality of tracks 62 thereby creating an interlocking engagement between the arbitrary block 12 and the adjacent block 13. Accordingly, the first plurality of ridges 64 is engaged with the first plurality of tracks 62.

Figure 4:
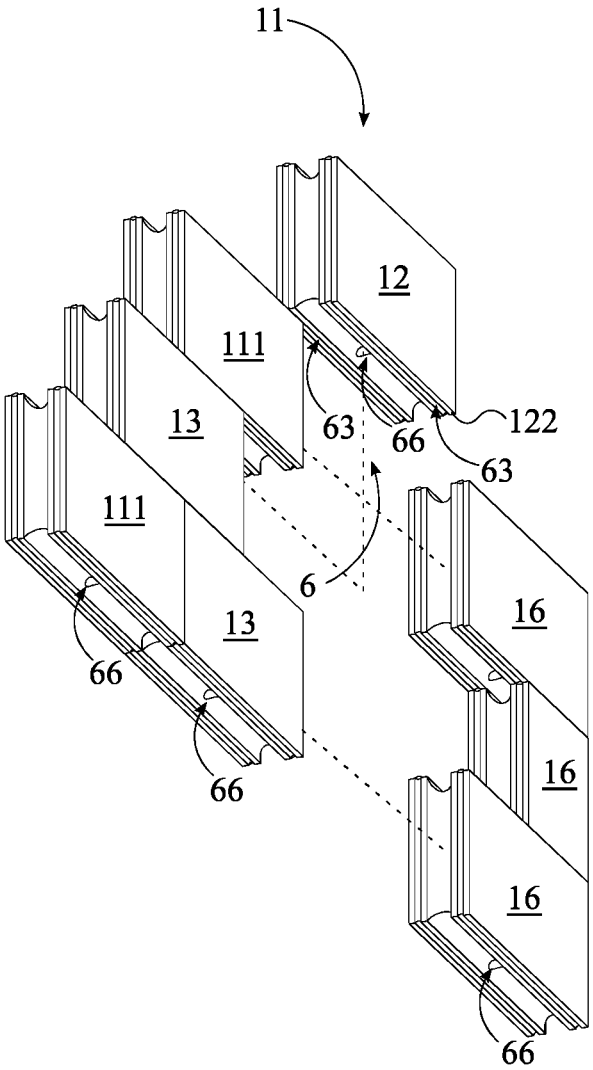
FIG. 4 is a bottom exploded view of the planar base body illustrating the connection between the arbitrary block and the adjacent block.

Referring to FIG. 2 and FIG. 4, similarly, the corresponding features 61 comprises a second plurality of tracks 63 and a second plurality of ridges 65. Accordingly, each of the second plurality of ridges 65 forms an interlocking connection with a corresponding track from the second plurality of tracks 63. Preferably, the second plurality of ridges 65 and the second plurality of tracks 63 are horizontally oriented to the planar base body 11. As such, the second plurality of tracks 63 traverses into a first lateral side 122 of the arbitrary block 12; Further, the second plurality of ridges 65 is integrated into a second lateral side 132 of the adjacent block 13. This allows the arbitrary block 12 and the adjacent block 13 to be stacked on top of each other in the vertical direction. As such, the first lateral side 122 of the arbitrary block 12 and the second lateral side 132 of the adjacent block 13 is positioned adjacent to each other. This enables the second plurality of ridges 65 to engage the first plurality of tracks 63 thereby creating an interlocking engagement between the arbitrary block 12 and the adjacent block 13. Accordingly, the second plurality of ridges 65 is engaged with the second plurality of tracks 63.

Figure 5:
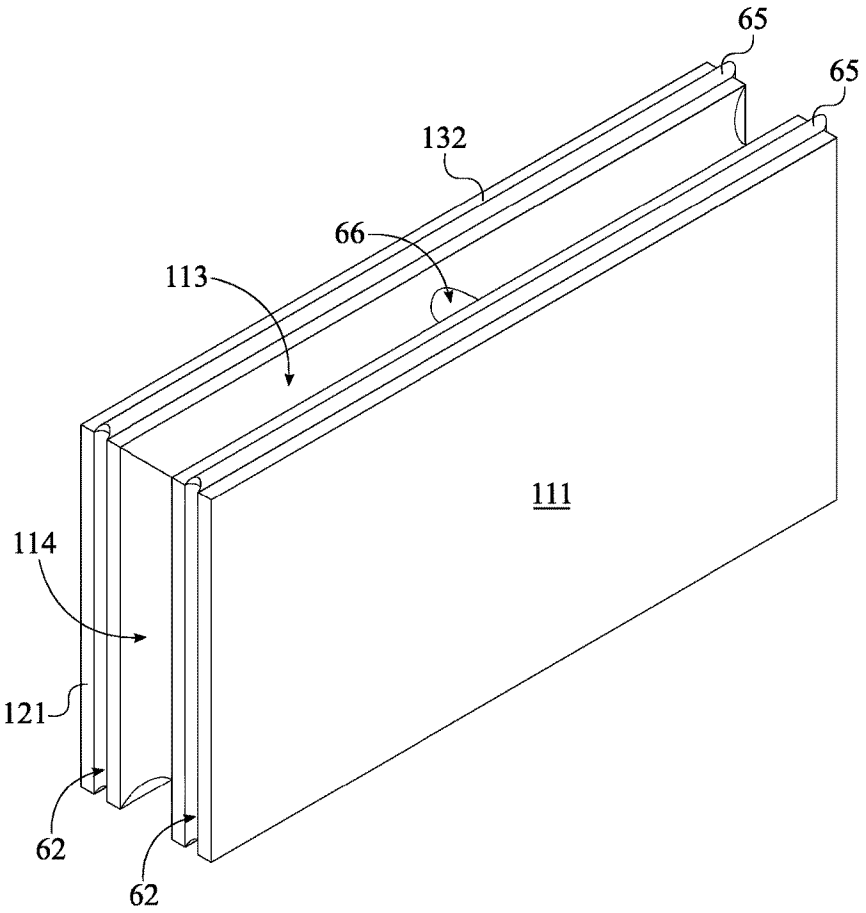
FIG. 5 is a top perspective view of the block illustrating the orientation of the first vertical recess and the second lateral recess.
Figure 6:
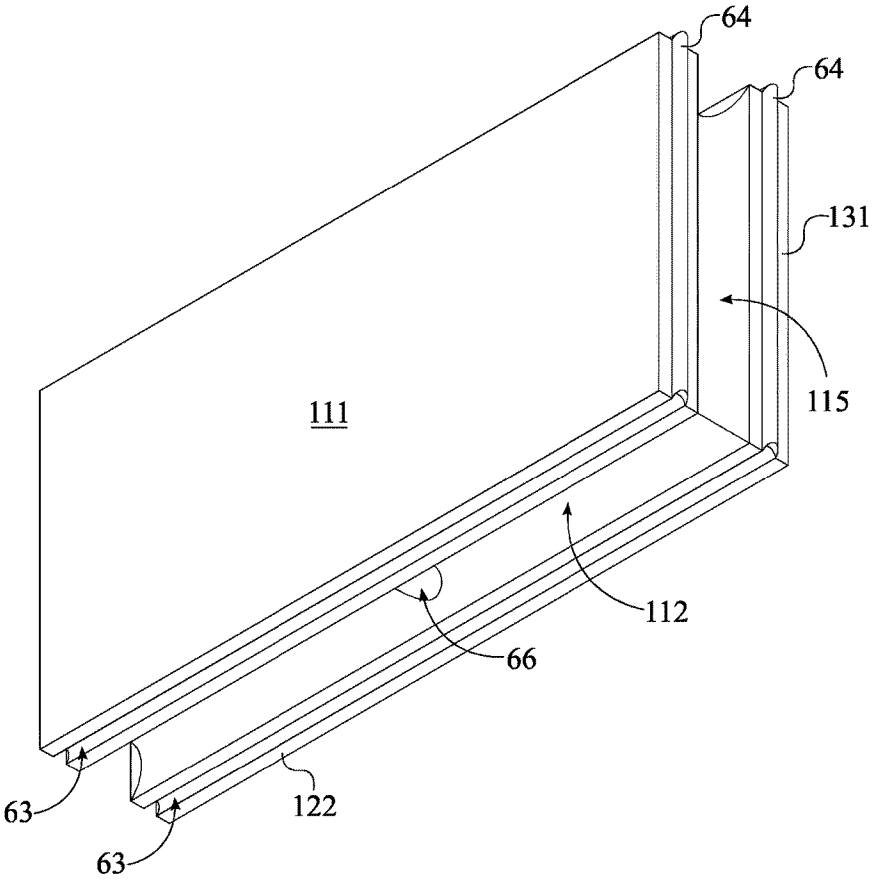
FIG. 6 is a bottom perspective view of the block illustrating the orientation of the second vertical recess and the first lateral recess.

Referring to FIG. 5 and FIG. 6, the preferred embodiment of the first plurality of tracks 62 comprises a pair of semi-circular grooves extending across the first vertical side 121 of the arbitrary block 12. The pair of semi-circular grooves is oriented parallel to the arbitrary block 12. Similarly, the first plurality of ridges 64 comprises a pair of semi-circular protrusions that fits within the pair of semi-circular grooves. The pair of semi-circular grooves preferably extends out of the second vertical side 131 of the adjacent block 13. Further, the pair of semi-circular ridges is oriented parallel to the adjacent block 13. This enables first vertical side 121 of the arbitrary block 12 to attach parallel to the second vertical side 131 of the adjacent block 13, thereby preserving the proper alignment.

Similarly, the preferred embodiment of the second plurality of tracks 63 comprises a pair of semi-circular cuts extending across the second lateral side 122 of the arbitrary block 12. The pair of semi-circular grooves is oriented parallel to the arbitrary block 12. Similarly, the second plurality of ridges 65 comprises a pair of semi-circular protrusions that fits within the pair of semi-circular grooves. The pair of semi-circular grooves preferably extends out of the second vertical side 131 of the adjacent block 13. Further, the pair of semi-circular ridges is oriented parallel to the adjacent block 13. This enables first lateral side 122 of the arbitrary block 12 to attach parallel to the second lateral side 132 of the adjacent block 13, thereby preserving the proper alignment.

To assemble the planar base body 11, each of the first plurality of tracks 62 is attached into a corresponding ridge from the first plurality of ridges 64. This secures the arbitrary block 12 to the side of the adjacent block 13. Similarly, each of the second plurality of tracks 63 is attached into a corresponding ridge from the second plurality of ridges 65. This secures the arbitrary block 12 to the side of the adjacent block 13. Similarly, each of the second plurality of tracks 63 is attached into a corresponding ridge from the second plurality of ridges 65. This secures the arbitrary block 12 to the side of the adjacent block 13. Similarly, each of the second plurality of tracks 63 is attached into a corresponding ridge from the second plurality of ridges 65. This secures the arbitrary block 12 to the top of the adjacent block 13.

Referring back to FIG. 5 and FIG. 6, in the preferred embodiment, each of the plurality of blocks 111 is fashioned with vertical and horizontal recesses which form circular channels through the planar base body 11 when assembled. This allows concrete and rebar to be inserted into the planar base body 11. Accordingly, each of the plurality of blocks 111 comprises a block body 116, a central mounting hole 66, a first lateral recess 112, a second lateral recess 113, a first vertical recess 114, and a second vertical recess 115. The first lateral recess 112 and the second lateral recess 113 are used to form long horizontal channels 17 through the planar base body 11. As such, the first lateral recess 112 traverses into a first lateral side 122 of the block body 116. Further, the second lateral recess 113 traverses into a second lateral side 132 of the block body 116, opposite the first lateral recess 112. Alternately, the first vertical recess 114 and the second vertical recess 115 are used for vertical channels 18 in the planar base body 11 for the insertion of concrete and rebar. As such, the first vertical recess 114 traverses into a first vertical side 121 of the block body 116. Further, the second vertical recess 115 traverses into a second vertical side 131 of the block body 116, opposite the first vertical recess 114. Further, the central mounting hole 66 traverses through the block body 116 from the first lateral side 112 to the second lateral side 113. This helps align the plurality of blocks 111 during assembly of the planar base body 11.

Figure 11:
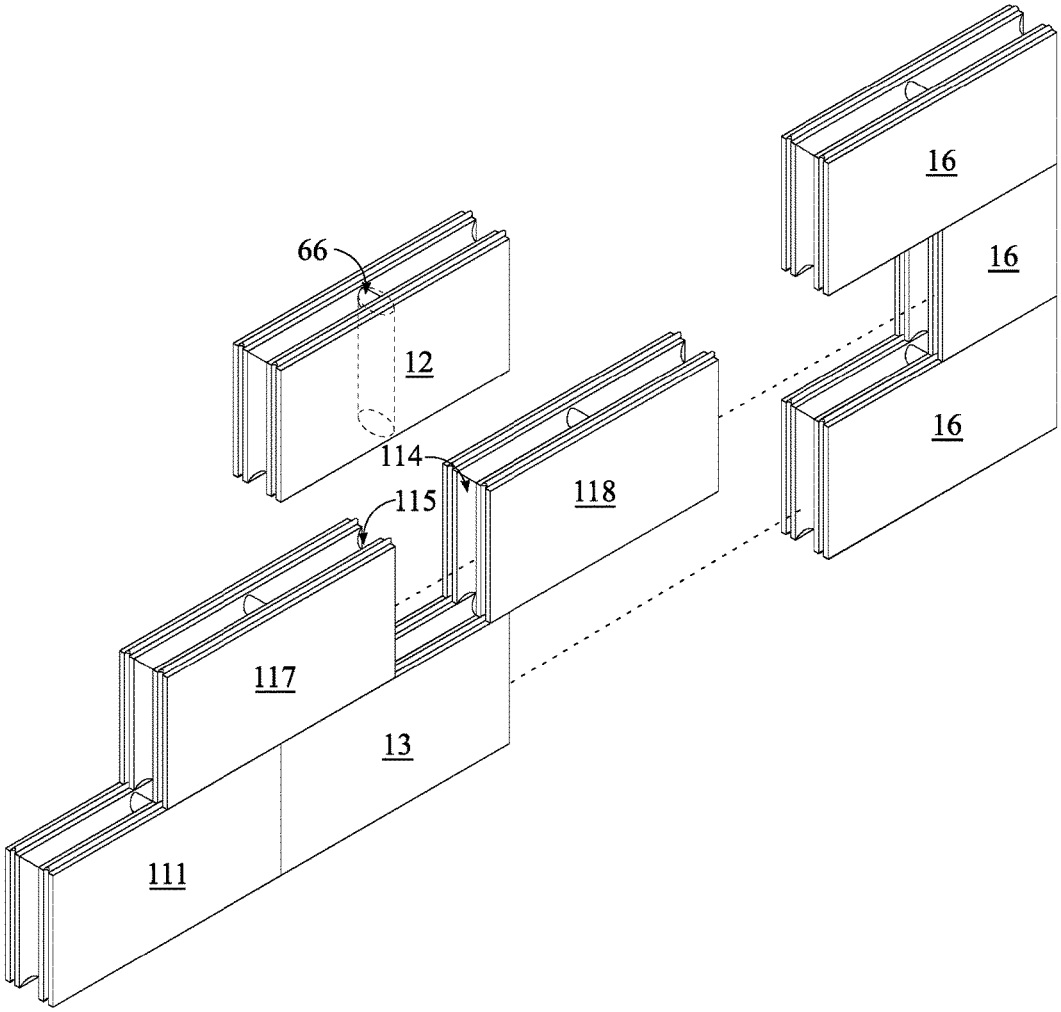
FIG. 11 is a top perspective exploded view of the planar base body showing the concentric positioning of the central mounting hole to the first adjacent block and the second adjacent block.

Referring to FIG. 11, the central mounting hole 66 enables the plurality of blocks 111 to be arranged in a staggered formation while still preserving the alignment of the circular channels. As such, the central mounting hole 66 of an arbitrary block 12 from the plurality of blocks 111 is concentrically aligned with the first vertical recess 114 of a first adjacent block 117 from the plurality of blocks 111 and the second vertical recess 115 of a second adjacent block 118 from the plurality of blocks 111.

Figure 7:
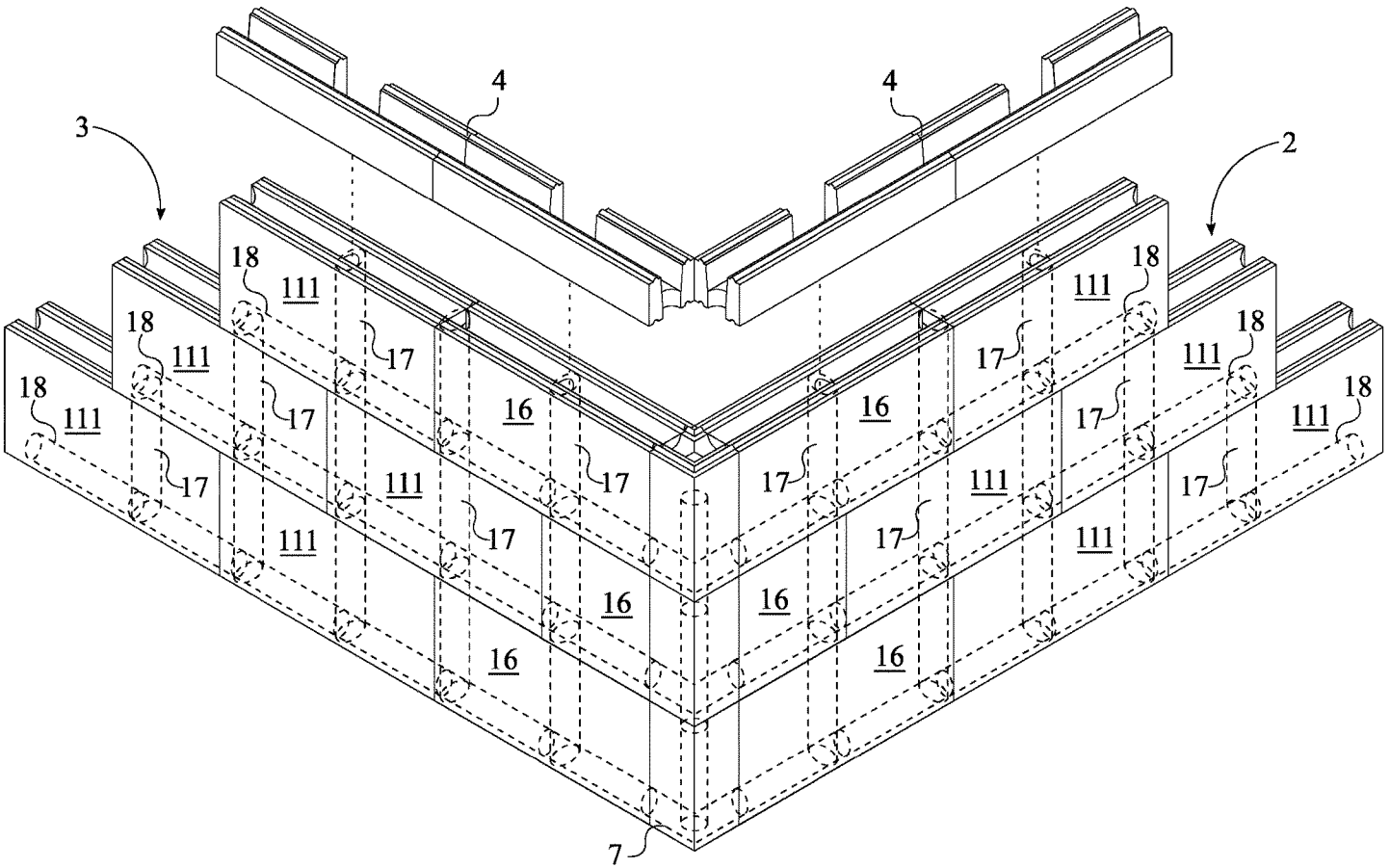
FIG. 7 is a rear exploded view of the first wall-structure and the second wall-structure engaged to a first embodiment of the corner lining.

Referring to FIG. 7, in the preferred embodiment, the at least one wall-structure 1 comprises a first wall-structure 2 and a second wall-structure 3. The first wall-structure 2 and the second wall-structure 3 enclose an interior space of a building or a similar structure. Accordingly, the first wall-structure 2 is mounted at an angle to the second wall-structure 3 by a corner interface 7. In the preferred embodiment, the corner interface 7 creates a 90-degree angle between the first wall-structure 2 and the second wall-structure 3. Alternately, the corner interface 7 may create an obtuse or acute angle between the first wall-structure 2 and the second wall-structure 3 depending on the overall shape of the structure.

Figure 9:
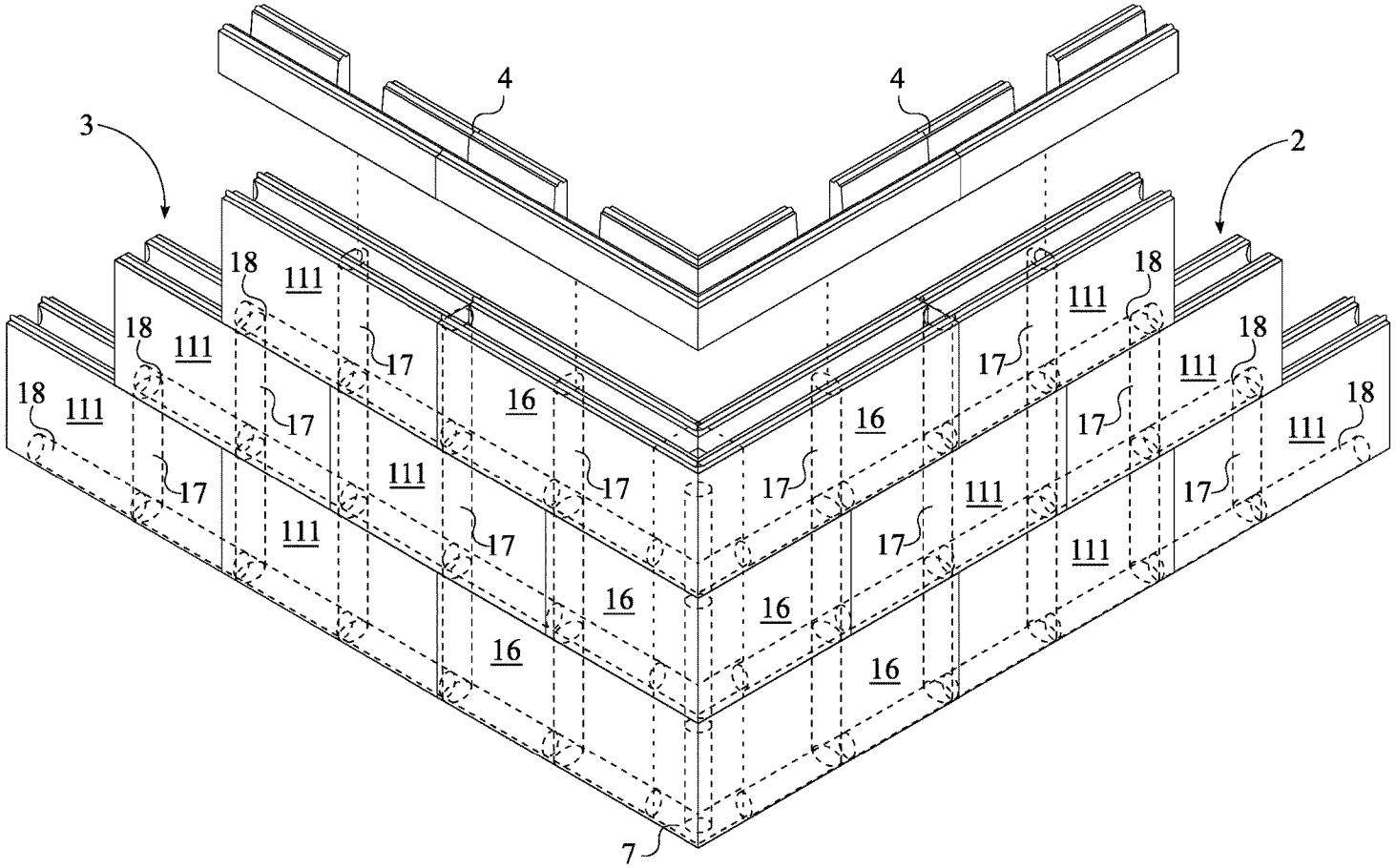
FIG. 9 is a rear exploded view of the first wall-structure and the second wall-structure engaged to a second embodiment of the corner lining.
Figure 10:
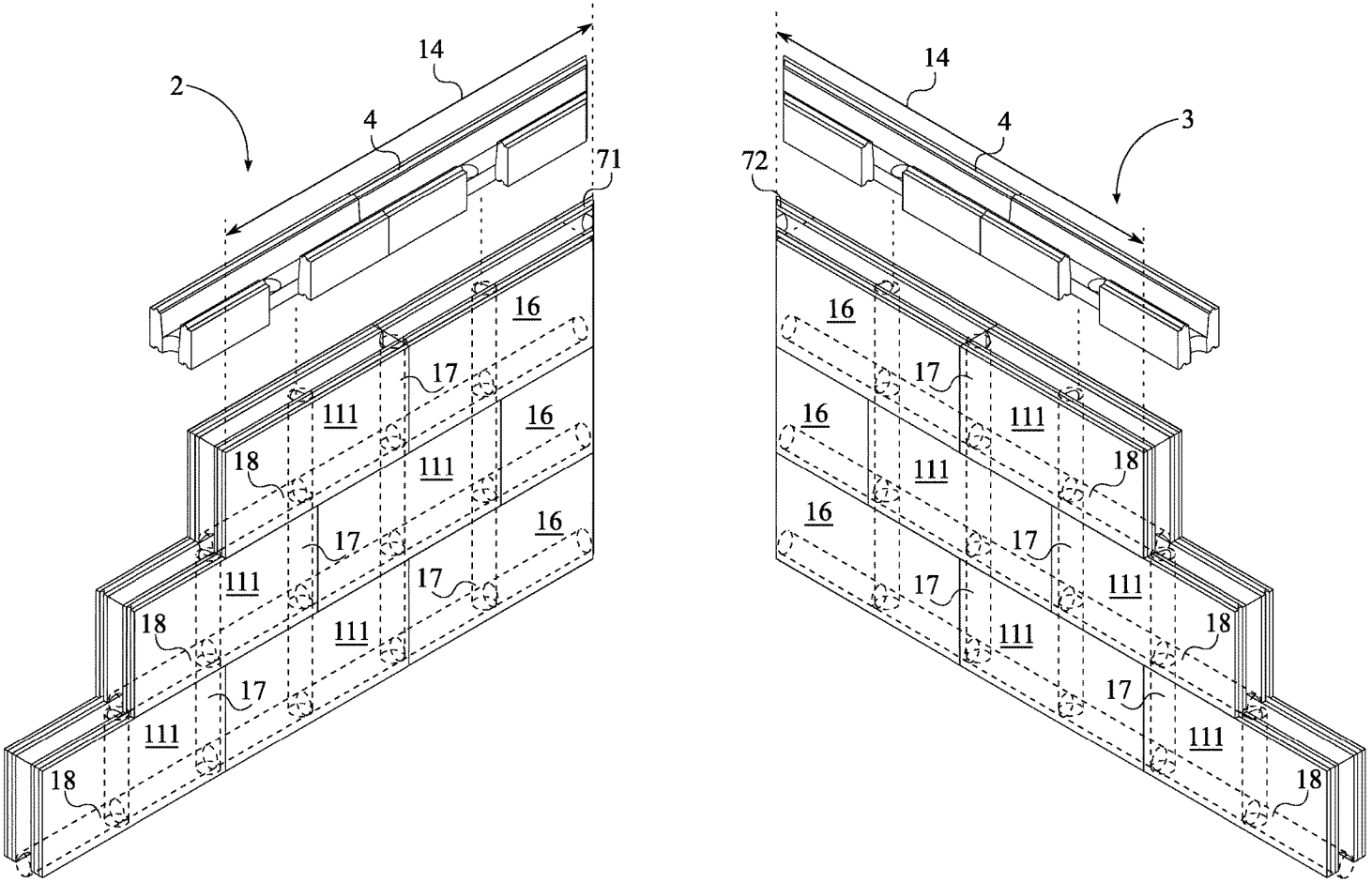
FIG. 10 is a front exploded view of the first wall-structure and the second wall-structure engaged to a first wedge section and a second wedge section.

Referring to FIG. 9 and FIG. 10, the preferred embodiment of the corner interface 7 comprises a first wedge section 71 and a second wedge section 72. In the preferred embodiment the first wedge section 71 comprises a plurality of wedges serially connected to each other. This allows the first wedge section 71 to successfully scale the height of the first wall-structure 2. As such, the first wedge section 71 is connected adjacent to the first wall-structure 2. Further, the first wedge section 71 is positioned perpendicular to the first lengthwise edge 14 of the first wall-structure 2. Similarly, the second wedge section 72 also comprises a plurality of wedges serially connected to each other. This allows the second wedge section 72 to successfully scale the height of the second wall-structure 3. As such, the second wedge section 72 is connected adjacent to the second wall-structure 3. Further, the second wedge section 72 is positioned perpendicular to the first lengthwise edge 14 of the second wall-structure 3. Finally, the first wedge section 71 is positioned adjacent to the second wedge section 72. In the preferred embodiment, the first wedge section 71 and the second wedge section 72 are flushed at 45-degree angles, thereby creating a 90-degree angle between the first wall-structure 2 and the second wall-structure 3.

Figure 8:
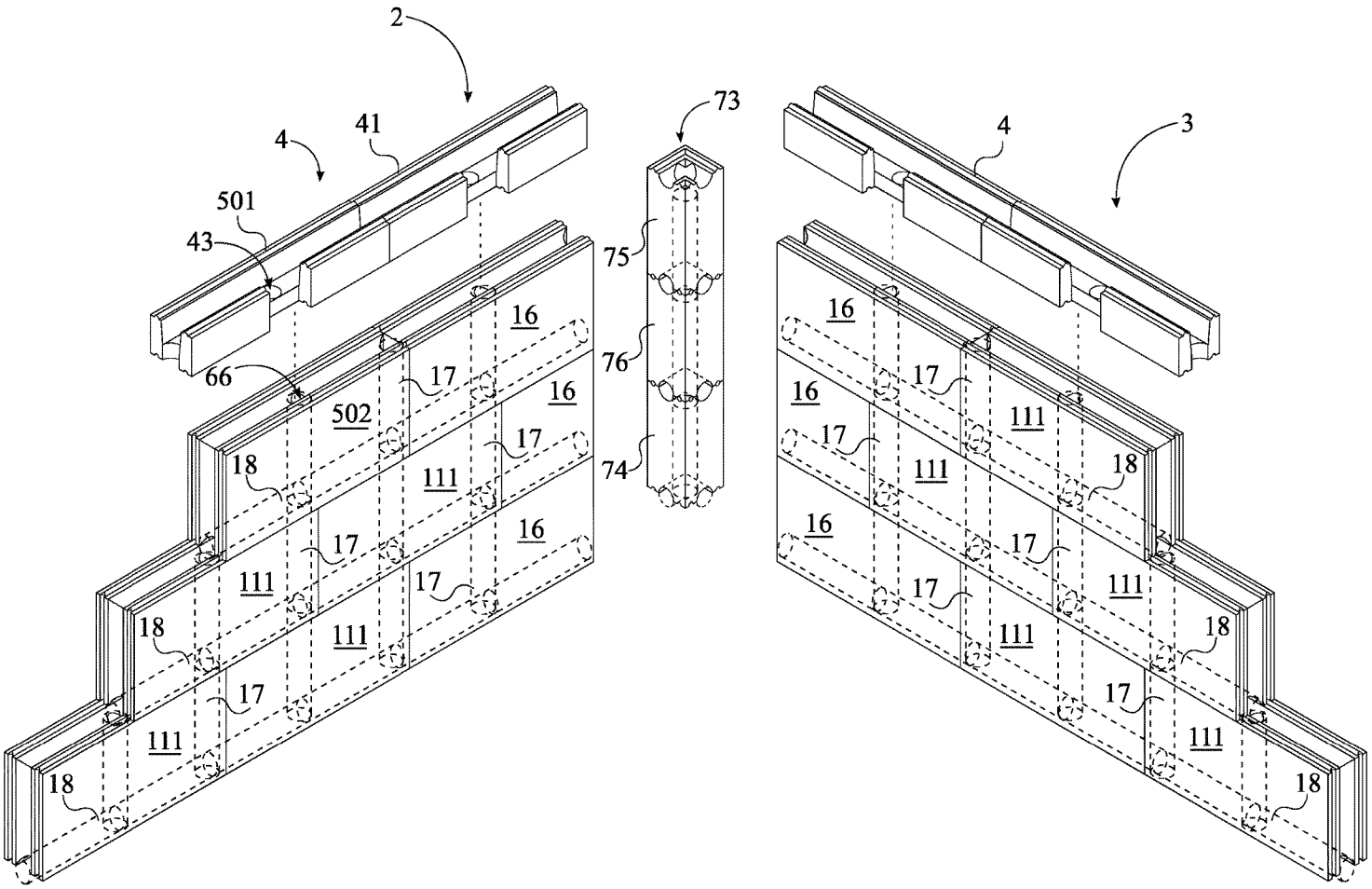
FIG. 8 is a front exploded view of the first wall-structure and the second wall-structure engaged to a plurality of corner blocks.
Figure 12:
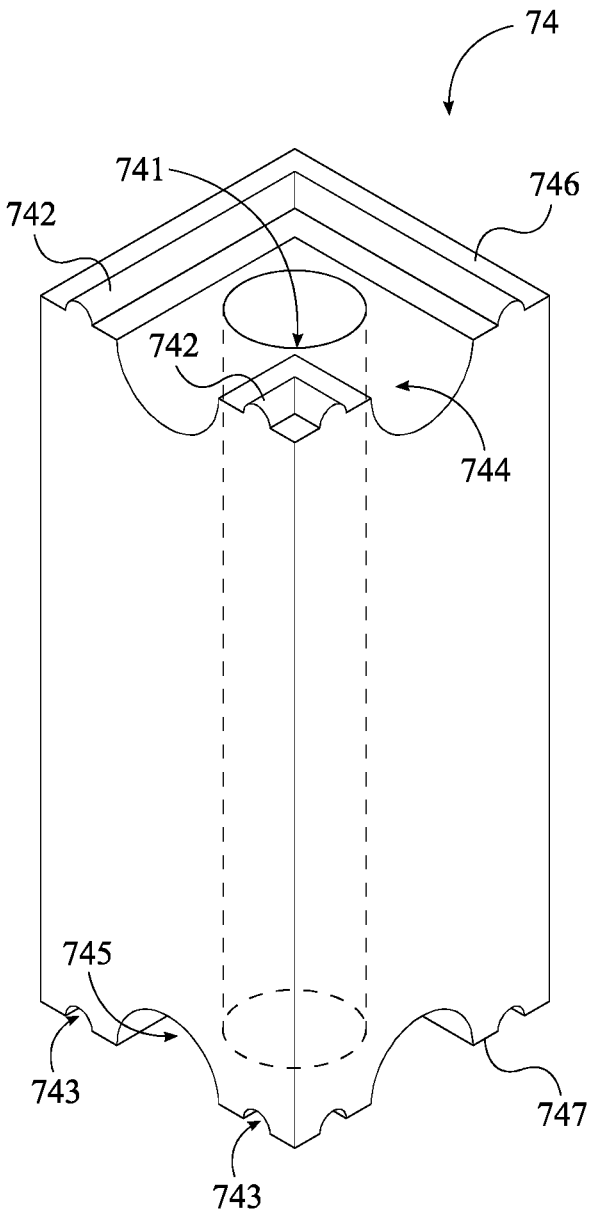
FIG. 12 is a top perspective view of the corner block.

Referring to FIG. 8 and FIG. 12, in another possible embodiment, the corner interface 7 comprises a corner lining 73. Unlike the first wedge section 71 and the second wedge section 72 which are distributed between the first wall-structure 2 and the second wall-structure 3, the corner lining 73 is a single structure for attaching the first wall-structure 2 to the second wall-structure 3. The corner lining 73 comprises a plurality of corner blocks 74. The plurality of corner blocks 74 is serially attached on top of each other. Each corner block 74 comprises a central hole 741, a plurality of protrusions 742, and a plurality of cuts 743. The preferred corner block has a prismatic body with sides at 90-degree angle to each other. The plurality of protrusions 742 is connected onto a first surface 746 of each corner block. Like the first plurality of ridges 64 and the second plurality of ridges 65, the plurality of protrusions 742 is a semicircular protrusion that extends out of the first surface 746. In the preferred implementation, the first surface 746 is oriented facing upwards. The plurality of cuts 743 traverses into a second surface 747 of each corner block, opposite the first surface 746. The second surface 747 is oriented facing downwards, thereby enabling the plurality of cuts 743 to engage the plurality of protrusions 742.

Referring to FIG. 12, each corner block 74 further comprises a first L-recess 744 and a second L-recess 745. The central hole 741, the first L-recess 744, and the second L-recess 745 allows concrete and rebar to be embedded between the plurality of corner blocks 74, forming the main structural element that holds the corner lining 73 together. As such, the first L-recess 744 traverses into each corner block 74 from the first surface 746. Similarly, the second L-recess 745 traverses into each corner block 74 from second surface 747. During assembly, the first surface 746 is positioned coincident to the second surface 747, thereby making the corner lining 73 seamless. Similarly, the central hole 741 traverses through the corner block from the first surface 746 to the second surface 747. This allows cement to be poured into the corner lining 73.

To secure the plurality of corner blocks 74 to each other, the first L-recess 744 and the second L-recess 745 connect on top of each other. Accordingly, the first L-recess 744 of an arbitrary block 75 from the plurality of corner blocks 74 is positioned adjacent to the second L-recess 745 of an adjacent block 76 from the plurality of corner blocks 74. In the preferred embodiment, the corner interface 7 is held together by the interlocking connection between the plurality of cuts 743 and the plurality of protrusions 742. As such, the plurality of cuts 743 of the arbitrary block 76 is engaged to the plurality of protrusions 742 of the adjacent block 76.

Referring back to FIG. 3, to enable the corner lining to attach to the planar base body 11, a plurality of corner-most blocks 16 is provided. The plurality of corner-most blocks 16 is positioned along the first-widthwise edge 19. Each of the plurality of corner-most blocks 16 is attached adjacent to the adjacent block 13 from the plurality of blocks 111, along the first lengthwise edge 14. The plurality of corner-most blocks 16 allows the corner interface 7 to successfully attach to the planar base body 11. As such, a flat-first lateral side 161 of each of the plurality of corner-most blocks 16 is positioned coplanar to each other. The flat first lateral side of each of the plurality of corner-most blocks 16 allows the planar base body 11 to seamlessly connect to the flat surface of the corner interface 7. Accordingly, the first lining 4 is positioned perpendicular to the flat-first lateral side 161 of the each of the plurality of corner-most blocks 16.

Figure 13:
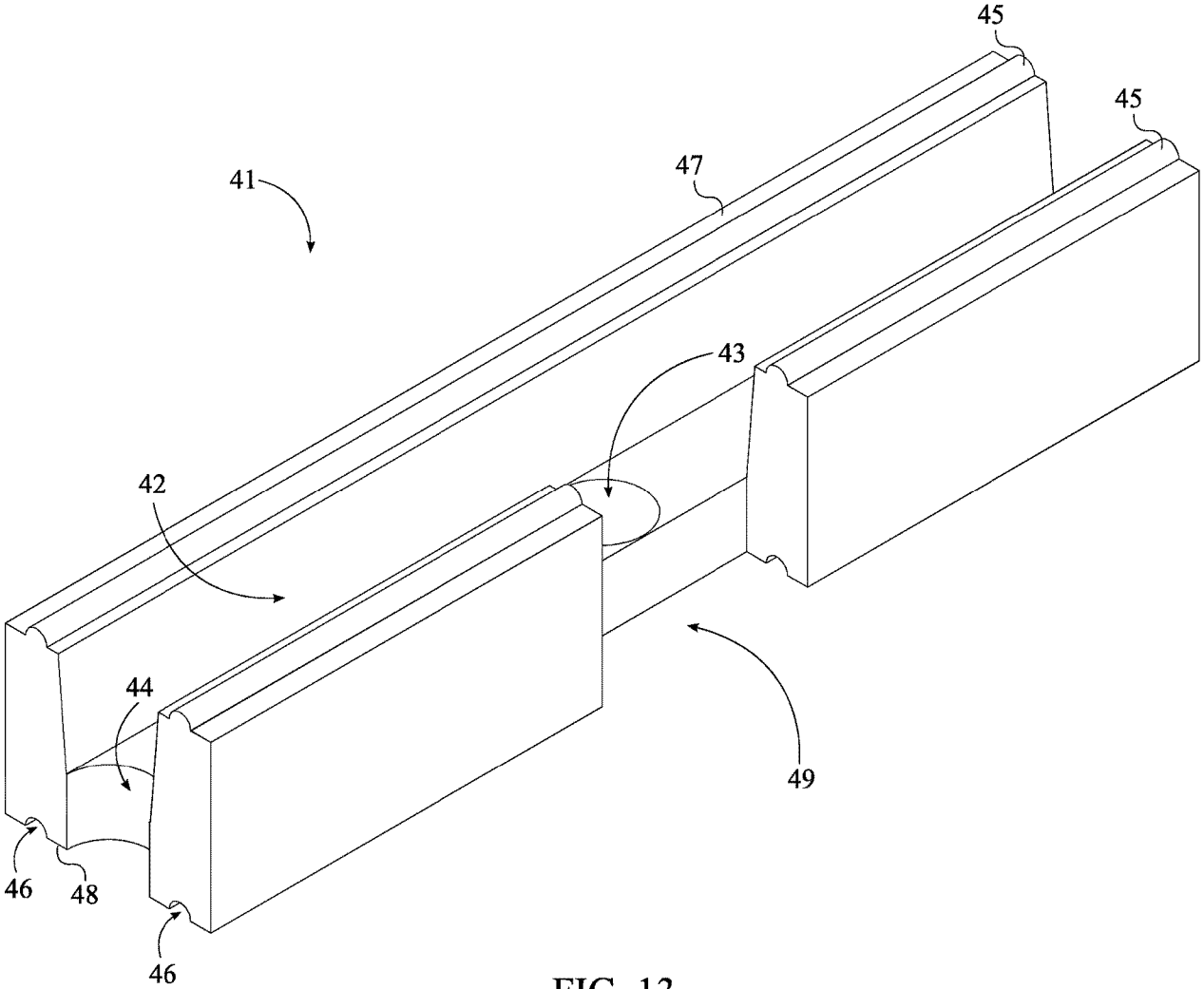
FIG. 13 is a top perspective view of a ceiling-mounting block.
Figure 14:
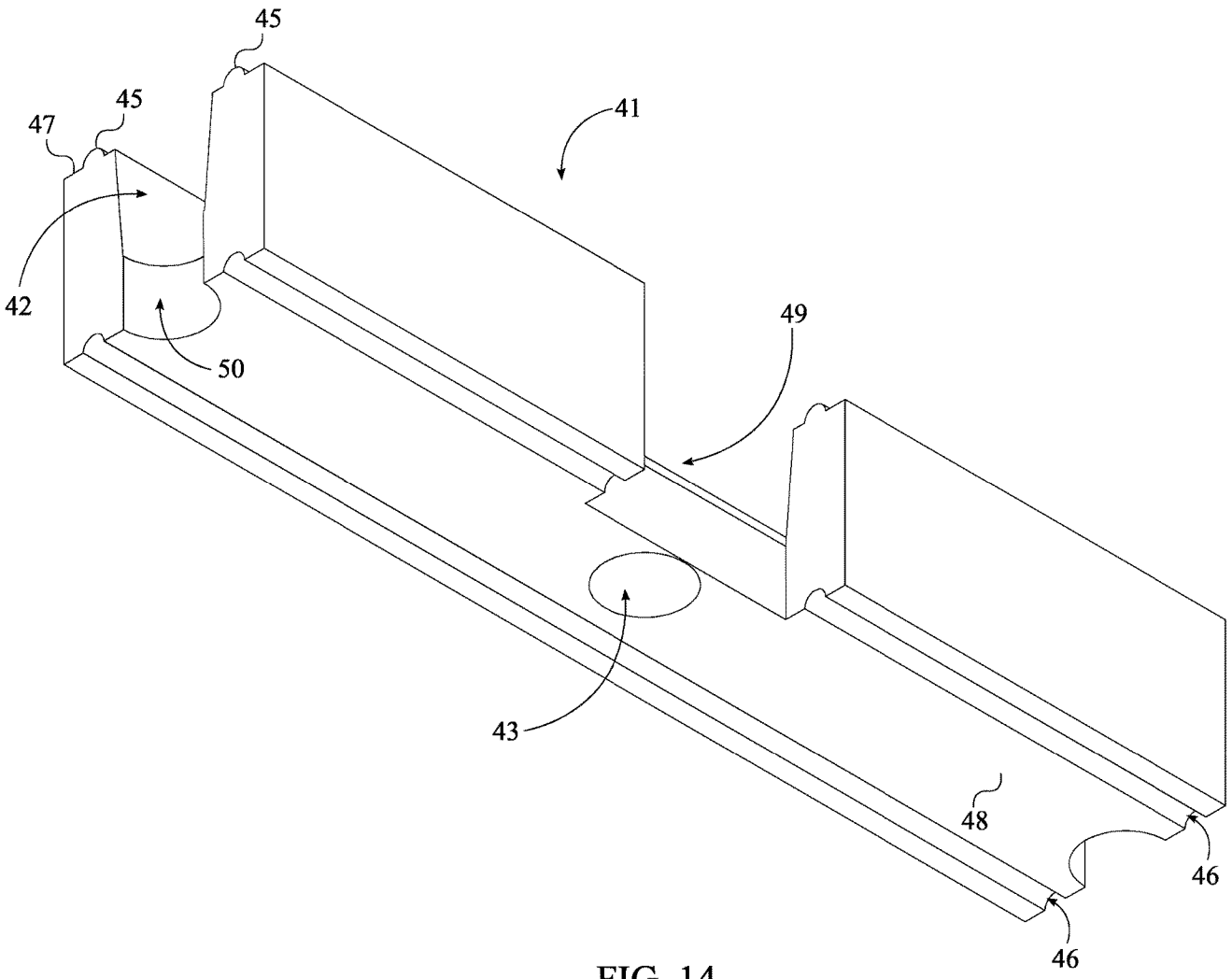
FIG. 14 is a bottom perspective view of a floor-mounting block.

As can be seen in FIG. 1, FIG. 13, and FIG. 14, the preferred embodiment of the first lining 4 comprises a plurality of ceiling-mounting blocks 41. The plurality of ceiling-mounting blocks 41 attach along the sides of the ceiling, thereby securely fastening the ceiling to the planar base body 11. Accordingly, the plurality of ceiling-mounting blocks 41 is distributed along the first lengthwise edge 14. Further, each of the plurality of ceiling-mounting blocks 41 is serially connected to each other. This allows the first lining 4 to span the width of the planar base body 11.

Further, each of the plurality of ceiling-mounting blocks 41 comprises a ceiling-mounting slot 42, a central cavity 43, a first lateral cavity 44, a first lateral cavity 50, a plurality of ceiling-supporting protrusions 45, and a plurality of block-mounting slots 46. The ceiling-mounting slot 42 traverses into the ceiling-mounting block 41 from an upward-facing side 47 of the ceiling-mounting block 41. In the preferred embodiment, the edge of the ceiling bends at a 90-degree angle. As such, edge of the ceiling is inserted into the ceiling-mounting slot 42. The central cavity 43 traverses through the ceiling-mounting block 41. Accordingly, the central cavity 43 is concentrically positioned to the central mounting hole 66 of the arbitrary block 12. Similarly, the first lateral cavity 44 fits over the lateral recess of the arbitrary block 12 to form a horizontal channel through the planar base body 11 and the first lining 4. As such, the first lateral cavity 44 terminally traverses from a downward-facing side 48 of the ceiling-mounting block 41 into the ceiling-mounting block 41. Similarly, the second lateral cavity 50 terminally traverses from the downward-facing side 48 into the ceiling-mounting slot 42, opposite of the first lateral cavity 44.

Figure 15:
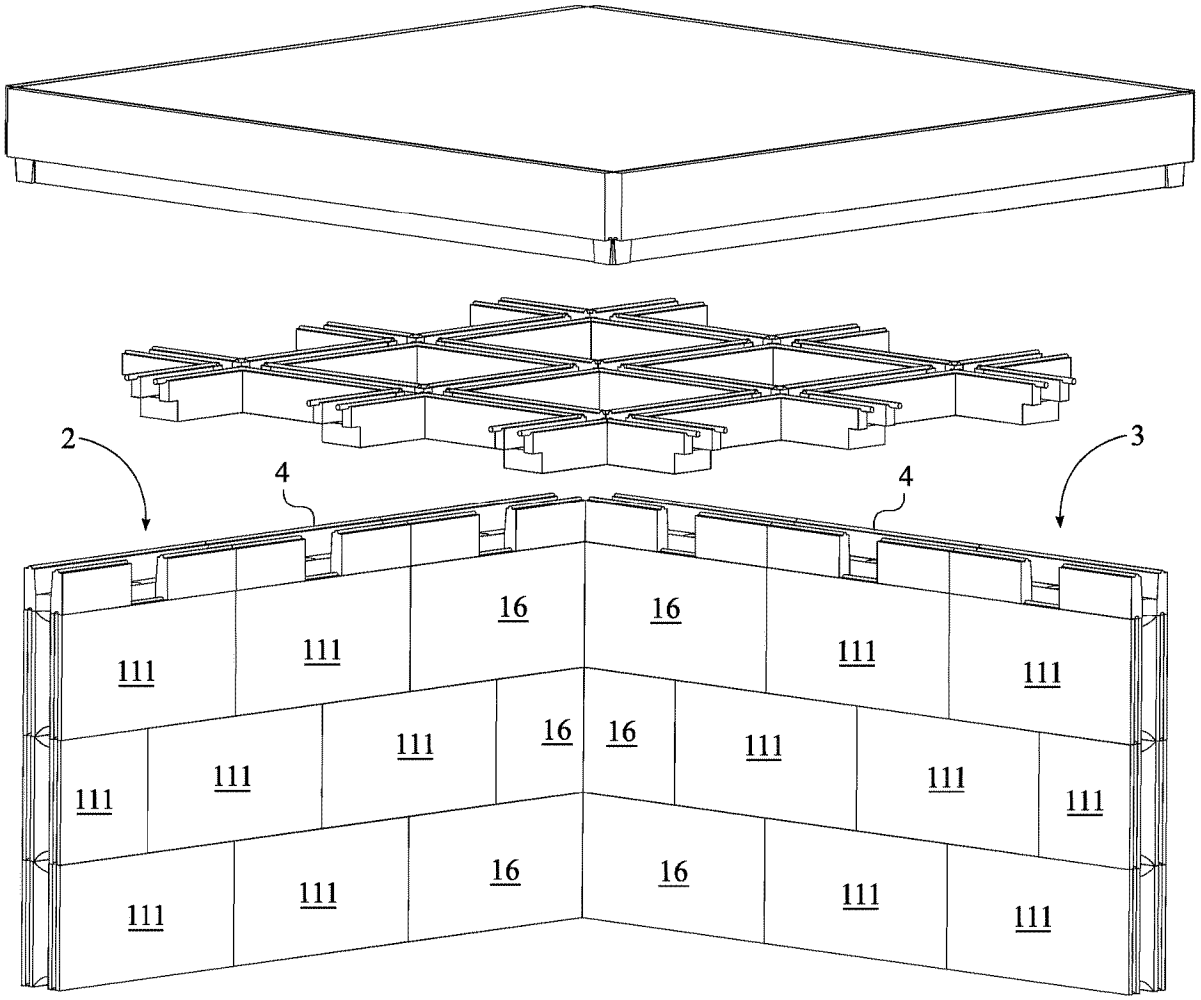
FIG. 15 is a perspective exploded view of a ceiling mounted onto the first wall-structure and the second wall-structure.
Figure 16:
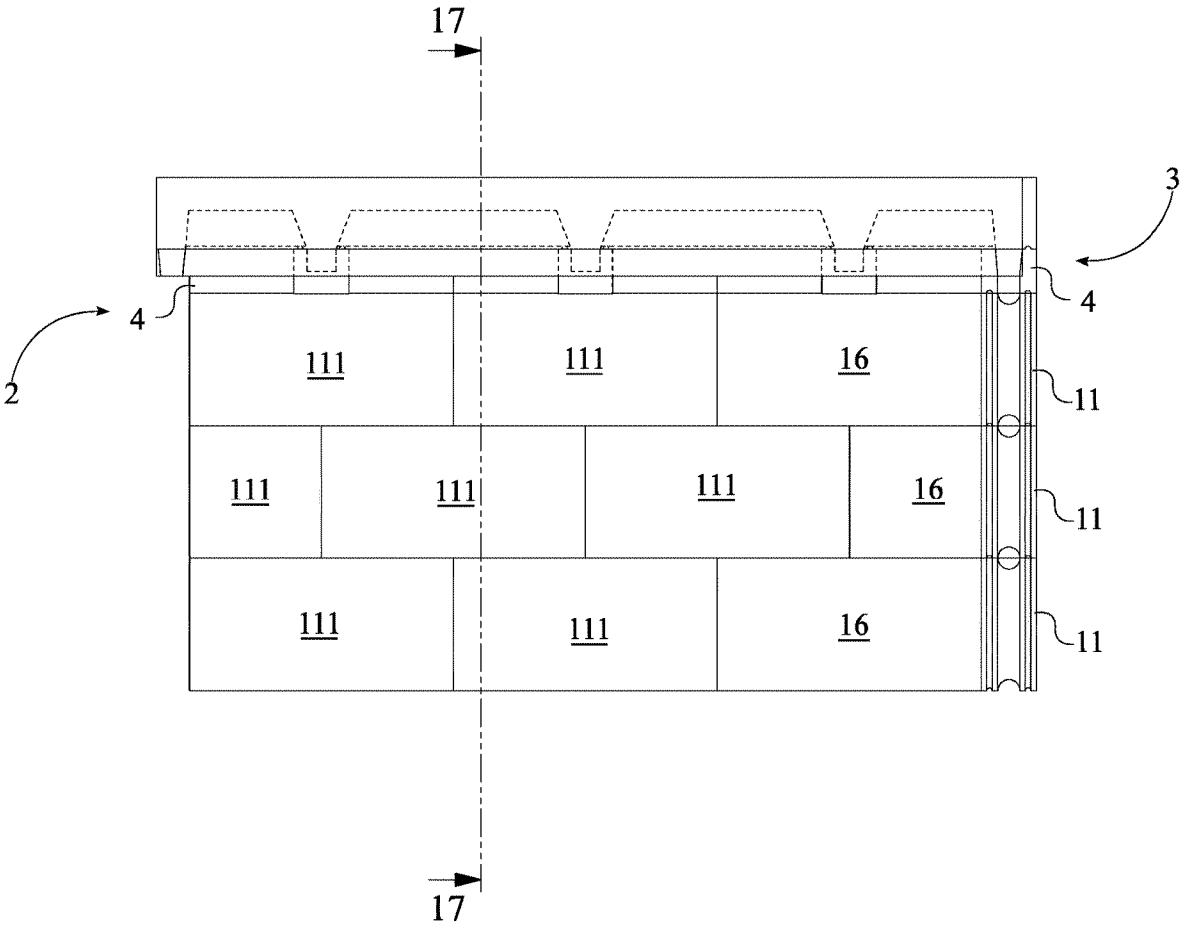
FIG. 16 is a side plan view of ceiling mounted to the first wall-structure and the second wall-structure.
Figure 17:
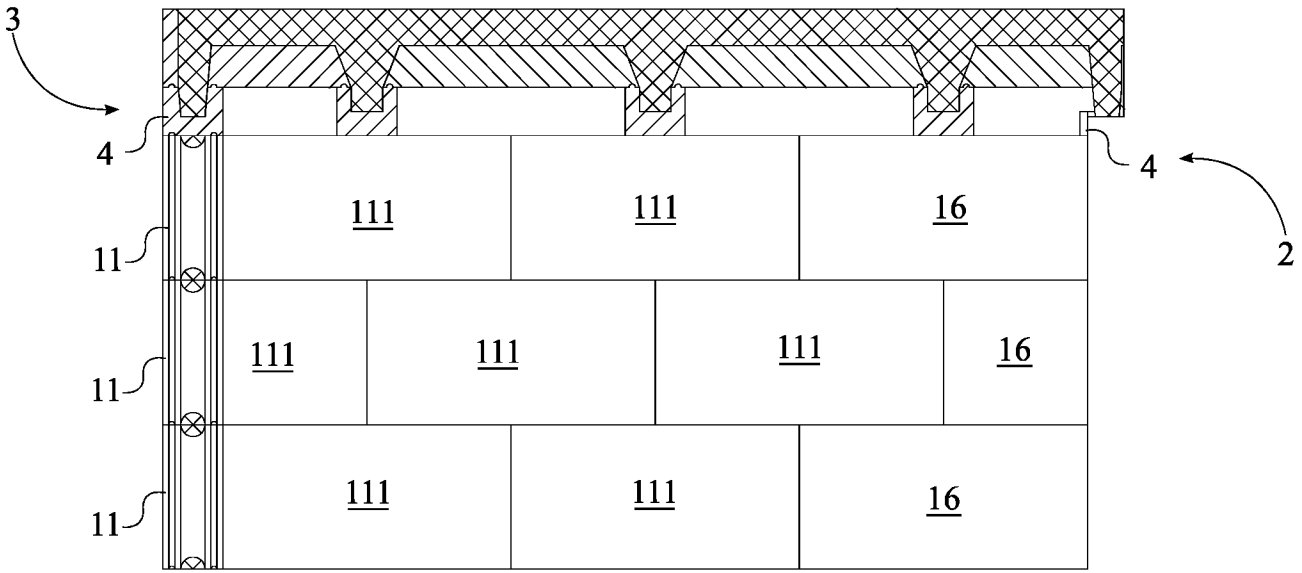
FIG. 17 is a cross-sectional view taken along line 17-17 in FIG. 16, showing the ceiling mounted into the first lining.

As can be seen in FIG. 15-17, preferably, the plurality of ceiling-supporting protrusions 45 enables the ceiling to mount onto the ceiling-mounting block. As such, the plurality of ceiling-supporting protrusions 45 is connected onto the upward-facing side 47. More specifically, each of the plurality of ceiling-supporting protrusions 45 fits into a groove in an insulation plate fitted between the ceiling and the ceiling-mounting block. Alternately, the plurality of block-mounting slots 46 traverses into the ceiling-mounting block 41 from the downward-facing side 48 of the ceiling-mounting block 41. The plurality of block-mounting slots 46 mounts the ceiling-mounting block on top of the arbitrary block 12. More specifically, the each of the plurality of block-mounting slots 46 engages a corresponding ridge from the second plurality of ridges 65.

Finally, a ceiling-joist slot 49 allows a ceiling joist to be mounted onto the ceiling-mounting block. The ceiling joist supports the weight of the ceiling and any other item placed on the ceiling. As such, the ceiling-joist slot 49 traverses into the ceiling-mounting block 41 from the upward-facing side 47 to the downward-facing side 48. Further, the ceiling-joist slot 49 is positioned adjacent to the central cavity 43. This allows the ceiling joist to be mounted perpendicular to the planar base body 11 and successfully span the length or width of the ceiling.

In the preferred embodiment, the plurality of block-mounting slots 46 allows the plurality of ceiling-mounting blocks 41 to mount onto the planar base body 11. More specifically, the second plurality of ridges 65 is integrated into a second lateral side 132 of the adjacent block 13. In other words, the plurality of block-mounting slots 46 is engaged with the second plurality of ridges 65. Once mounted, the plurality of ceiling-mounting blocks 41 and the planar base body 11 are held together by a concrete and rebar.

Referring back to FIG. 8, accordingly, the central cavity 43 for an arbitrary block 501 from the plurality of ceiling-mounting blocks 41 is concentrically aligned with the central mounting hole 66 of an arbitrary block 502 from the plurality of blocks 46. This allows concrete to flow through the planar base body 11 into the plurality of ceiling-mounting blocks 41.

Although the invention has been explained in relation to its preferred embodiment, it is to be understood that many other possible modifications and variations can be made without departing from the spirit and scope of the invention as hereinafter claimed.

What is claimed is:

1. An insulated interlocking superblock assembly comprising:

at least one wall-structure;

the wall-structure comprising a planar base body, a first lining, a plurality of interlocking features;

the planar base body comprising a plurality of blocks;

the plurality of blocks being arranged into a grid pattern;

an arbitrary block from the plurality of blocks being engaged to an adjacent block from the plurality of blocks by a corresponding feature from the plurality of interlocking features, wherein the arbitrary block is any block from the plurality of blocks;

the first lining being attached along a first lengthwise edge of the planar base body;

the first lining comprising a plurality of ceiling-mounting blocks;

the plurality of ceiling-mounting blocks being distributed along the first lengthwise edge; and each of the plurality of ceiling-mounting blocks being serially connected to each other.

2. The insulated interlocking superblock assembly as claimed in claim 1 comprising:

the corresponding feature comprising a first plurality of tracks and a first plurality of ridges;

the first plurality of tracks traversing into a first vertical side of the arbitrary block;

the first plurality of ridges being integrated into a second vertical side of the adjacent block;

the first vertical side of the arbitrary block and the second vertical side of the adjacent block being positioned adjacent to each other; and the first plurality of ridges being engaged with the first plurality of tracks.

3. The insulated interlocking superblock assembly as claimed in claim 1 comprising:

the corresponding feature comprising a second plurality of tracks and a second plurality of ridges;

the second plurality of tracks traversing into a first lateral side of the arbitrary block;

the second plurality of ridges being integrated into a second lateral side of the adjacent block;

the first lateral side of the arbitrary block and the second lateral side of the adjacent block being positioned adjacent to each other; and the second plurality of ridges being engaged with the second plurality of tracks.

4. The insulated interlocking superblock assembly as claimed in claim 1 comprising:

each of the plurality of blocks comprising a block body, a central mounting hole, a first lateral recess, a second lateral recess, a first vertical recess, and a second vertical recess;

the first lateral recess traversing into a first lateral side of the block body;

the second lateral recess traversing into a second lateral side of the block body, opposite the first lateral recess;

the first vertical recess traversing into a first vertical side of the block body;

the second vertical recess traversing into a second vertical side of the block body, opposite the first vertical recess; and the central mounting hole traversing through the block body from the first lateral side to the second lateral side.

5. The insulated interlocking superblock assembly as claimed in claim 4 comprising:

the central mounting hole of an arbitrary block from the plurality of blocks being concentrically aligned with the first vertical recess of a first adjacent block from the plurality of blocks and the second vertical recess of a second adjacent block from the plurality of blocks.

6. The insulated interlocking superblock assembly as claimed in claim 1 comprising:

a corner interface;

the at least one wall-structure comprising a first wall-structure and a second wall-structure; and the first wall-structure being mounted at an angle to the second wall-structure by the corner interface.

7. The insulated interlocking superblock assembly as claimed in claim 6 comprising:

the corner interface comprising a first wedge section and a second wedge section;

the first wedge section being connected adjacent to the first wall-structure;

the first wedge section being positioned perpendicular to the first lengthwise edge of the first wall-structure;

the second wedge section being connected adjacent to the second wall-structure;

the second wedge section being positioned perpendicular to the first lengthwise edge of the second wall-structure; and the first wedge section being positioned adjacent to the second wedge section.

8. The insulated interlocking superblock assembly as claimed in claim 6 comprising:

the corner interface comprising a corner lining;

the corner lining comprising a plurality of corner blocks;

the plurality of corner blocks being serially attached to each other;

each corner block comprising a central hole, a plurality of protrusions, a plurality of cuts, a first L-recess, and a second L-recess;

the plurality of protrusions being connected onto a first surface of each corner block;

the plurality of cuts traversing into a second surface of each corner block, opposite the first surface;

the first L-recess traversing into each corner block from the first surface;

the second L-recess traversing into each corner block from the second surface; and the central hole traversing through each corner block from the first surface to the second surface.

9. The insulated interlocking superblock assembly as claimed in claim 8 comprising:

the first L-recess of an arbitrary block from the plurality of corner blocks being positioned adjacent to the second L-recess of an adjacent block from the plurality of corner blocks; and the plurality of cuts of the arbitrary block being engaged to the plurality of protrusions of the adjacent block.

10. The insulated interlocking superblock assembly as claimed in claim 1 comprising:

the planar base body further comprising a plurality of corner-most blocks;

the plurality of corner-most blocks being positioned along a first-widthwise edge;

each of the corner-most blocks being attached adjacent to the arbitrary block from the plurality of blocks, along the first lengthwise edge;

a flat first lateral side of the each of the corner-most blocks being positioned coplanar to each other; and the first lining being positioned perpendicular to the flat first lateral side of the each of the corner-most blocks.

11. The insulated interlocking superblock assembly as claimed in claim 1 comprising:

the corresponding feature comprising a second plurality of ridges;

the second plurality of ridges being integrated into a second lateral side of the adjacent block; and a plurality of block-mounting slots being engaged with the second plurality of ridges.

12. The insulated interlocking superblock assembly as claimed in claim 1 comprising:

a central cavity for an arbitrary block from the plurality of ceiling-mounting blocks being concentrically aligned with a central mounting hole of an arbitrary block from the plurality of blocks.

13. The insulated interlocking superblock assembly as claimed in claim 10 comprising:

each of the ceiling-mounting blocks comprising a ceiling-mounting slot, a central cavity, a first lateral cavity, a second lateral cavity, a plurality of ceiling-supporting protrusion, and a plurality of block-mounting slots;

the ceiling-mounting slot traversing into the ceiling-mounting block from an upward-facing side of the ceiling-mounting block;

the central cavity traversing through the ceiling-mounting block;

the first lateral cavity terminally traversing from a downward-facing side of the ceiling-mounting block into the ceiling-mounting slot;

the second lateral cavity terminally traversing from the downward-facing side into the ceiling-mounting slot, opposite of the first lateral cavity;

the plurality of ceiling-supporting protrusions being connected onto the upward-facing side; and the plurality of block-mounting slots traversing into the ceiling-mounting block from the downward-facing side.

14. The insulated interlocking superblock assembly as claimed in claim 10 comprising:

a ceiling-joist slot;

the ceiling-joist slot traversing into the ceiling-mounting block from the upward-facing side to the downward-facing side; and the ceiling-joist slot being positioned adjacent to the central cavity.

* * * * *